US010673109B2

(12) United States Patent
Harper et al.

(10) Patent No.: US 10,673,109 B2
(45) Date of Patent: Jun. 2, 2020

(54) APPARATUS FOR CONNECTING FIRST AND SECOND WAVEGUIDE SECTIONS COMPRISING AN ADHESIVE DISPOSED IN CAVITIES BETWEEN CIRCUMFERENTIAL RIDGES AND A SLEEVE MEMBER

(71) Applicant: BAE SYSTEMS plc, London (GB)

(72) Inventors: Richard John Harper, Chelmsford (GB); Thomas Mark Plucinski, Chelmsford (GB); Stephen William McLaren, Stevenage (GB)

(73) Assignee: BAE SYSTEMS plc, London (GB)

( * ) Notice: Subject to any disclaimer, the term of this patent is extended or adjusted under 35 U.S.C. 154(b) by 110 days.

(21) Appl. No.: 16/075,233

(22) PCT Filed: Feb. 8, 2017

(86) PCT No.: PCT/GB2017/050308
§ 371 (c)(1),
(2) Date: Aug. 3, 2018

(87) PCT Pub. No.: WO2017/137737
PCT Pub. Date: Aug. 17, 2017

(65) Prior Publication Data

US 2019/0044205 A1 Feb. 7, 2019

(30) Foreign Application Priority Data

Feb. 10, 2016 (EP) ..... 16275023
Feb. 10, 2016 (GB) ..... 1602372.3

(51) Int. Cl.
*H01P 1/04* (2006.01)
*H01P 3/12* (2006.01)
(Continued)

(52) U.S. Cl.
CPC ..... *H01P 1/042* (2013.01); *H01P 3/12* (2013.01); *H01P 5/024* (2013.01); *H01P 11/002* (2013.01)

(58) Field of Classification Search
CPC ..... H01P 1/042; H01P 5/024; H01P 11/002
(Continued)

(56) References Cited

U.S. PATENT DOCUMENTS 2,561,130 A * 7/1951 McClellan ..... H01P 1/042 333/254
3,374,450 A 3/1968 Stewart
(Continued)

FOREIGN PATENT DOCUMENTS

GB 964530 7/1964
GB 971481 9/1964
(Continued)

OTHER PUBLICATIONS

GB Search Report under Section 17(5) received for GB Application No. 1602372.3, dated May 10, 2016. 3 pages.
(Continued)

*Primary Examiner* — Benny T Lee
(74) *Attorney, Agent, or Firm* — Finch & Maloney PLLC

(57) ABSTRACT

A waveguide comprising first and second waveguide sections, each waveguide section comprising a main body portion (12) and a connecting portion (14) at its distal end, said first and second waveguide sections being longitudinally aligned to define a conduit therethrough with a butted interface (28) therebetween, the connecting portion of each waveguide section having: (i) a first circumferential ridge (16) on its outer surface located adjacent its distal end, (ii) a second circumferential ridge (18) on its outer surface spaced apart from the first circumferential ridge, and (iii) a third circumferential ridge (20) on its outer surface located
(Continued)

between said first and second circumferential ridges, such that a first respective recess (19) is defined between said second and third circumferential ridges and a second respective recess (17) is defined between said first and third circumferential ridges; the waveguide further comprising a sleeve member (22) over said butted interface (28), such that a respective first cavity (19*a*) is defined between an inner surface of said sleeve member (22) and each said first recess (19) and a respective second cavity is defined between the inner surface of said sleeve member (22) and each said second recess (17), each said first cavity (19*a*) having a chemical adhesive therein operative to join said first and second waveguide sections together by means of said sleeve member (22).

20 Claims, 4 Drawing Sheets

(51) Int. Cl.
*H01P 11/00* (2006.01)
*H01P 5/02* (2006.01)

(58) Field of Classification Search
USPC ..... 333/254, 255
See application file for complete search history.

(56) References Cited

U.S. PATENT DOCUMENTS

| | | | | |
|---|---|---|---|---|
| 3,711,126 | A * | 1/1973 | Hara et al. ..... | H01P 1/042 285/116 |
| 4,537,468 | A | 8/1985 | Degoix et al. | |
| 2002/0109559 | A1 | 8/2002 | Pitschi | |

FOREIGN PATENT DOCUMENTS

| | | |
|---|---|---|
| GB | 1570187 | 6/1980 |
| WO | 2017/137737 | 8/2017 |

OTHER PUBLICATIONS

Extended European Search Report received for EP Application No. 16275023.6 dated Aug. 2, 2016. 9 pages.

International Search Report and Written Opinion received for PCT Application No. PCT/GB2017/050308. dated Apr. 13, 2017. 14 pages.

International Preliminary Report on Patentability received for PCT Application No. PCT/GB2017/050308. dated Aug. 23, 2018. 5 pages.

* cited by examiner

APPARATUS FOR CONNECTING FIRST AND SECOND WAVEGUIDE SECTIONS COMPRISING AN ADHESIVE DISPOSED IN CAVITIES BETWEEN CIRCUMFERENTIAL RIDGES AND A SLEEVE MEMBER

BACKGROUND

This invention relates generally to a waveguide, and a method of manufacturing a waveguide, for use in, for example, communication or radar applications.

Waveguides are generally used for connecting together transmitting and receiving equipment in, for example, communication or radar systems. A waveguide typically comprises a transmission line formed from a hollow conducting tube providing a conduit through which electromagnetic waves are propagated, and may be of any cross-sectional shape, such as, square, rectangular, circular or elliptical, as well as containing single or pairs of opposing ridges.

Regardless of the application in which waveguides are to be used, they are commonly provided with some means of connecting adjacent waveguide sections. The successful connection of waveguides for good Radio Frequency (RF) performance requires that the signals being carried by the waveguides are not significantly reflected, absorbed or distorted by the junction, i.e. the junction offers no appreciable discontinuity to the flow of microwave power. This requires that the internal cross-sections on each side of the junction are well aligned, there is low electrical resistance across the interface and that the point of good contact (i.e. low electrical resistance) occurs at the inside wall of the waveguide, where the electrical currents are generated by the passing signals within.

To this end, various mechanical joints are available, but traditionally, waveguide sections are each provided with flanged ends and connections to components and other discrete waveguide sections are made by using threaded bolts to pull together the flanged ends of the waveguides to form a contacting joint. Flange designs tend to be standardised and, in combination with the above-mentioned fixing bolts, provide the required alignment between waveguides with sufficient mechanical integrity to resist the applied physical forces occurring in service: in a space application, for example, such loads may arise in vibration during launch and differential thermal expansion when in orbit.

In communication systems, where a single waveguide may be carrying high level signals to be transmitted using two or more carrier frequencies, as well as low level received signals, another issue can occur, known as passive intermodulation. Passive intermodulation (PIM) is the generation of interfering signals caused by nonlinearities in the mechanical components of a system, and occurs when two signals mix together (amplitude modulation) to produce sum and difference signals and products within the same band, causing distortion. These effects can occur at waveguide interfaces and a common approach to minimising the effect is to ensure that there is a high contact pressure at the inside wall, usually achieved by providing a raised contact lip around the inside wall so the contact force applied by the fixing bolts is concentrated at this point.

In view of the proven electrical performance of bolted flanges, and similar mechanical joints, together with the reversibility and resultant flexibility thereof, they have long provided the most widely accepted method of joining waveguide sections to each other and/or other interfaces.

However, in modern communication satellites, for example, there can be hundreds or even thousands of waveguide junctions and the resultant mass of flanges and associated fixings can cause significant issues. For instance, the flanges require additional space to be provided at each joint as well as sufficient access to enable the fixing bolts to be tightened. Furthermore, more complex antennas may have many waveguides feeding into them, and in some cases there may be insufficient room for traditional flanged connections.

UK Patent No GB971481 describes a method of joining two waveguide sections together, wherein each waveguide section has, at a connecting end thereof, a respective sleeve section affixed around the waveguide section by means of an adhesive injected into an orifice or 'pocket' formed by complementary recesses in the outer wall of the waveguide section and the inner wall of the sleeve section. Subsequently, the two waveguide sections are joined together at sleeve section ends of the waveguide sections by providing a further sleeve member over the butted interface between the sleeve sections, and affixed thereto by means of an adhesive injected into orifices or 'pockets' formed by complementary recesses in the outer wall of each sleeve section and the inner wall of the sleeve member.

SUMMARY

There are a number of issues associated with the above-described method. Firstly, the method described necessitates the use of two sleeve layers, which significantly increases the overall diameter of the resultant waveguide. In many applications, this is simply not acceptable in view of space constraints. Thus, the above-described method is not suitable for many applications. Furthermore, whilst the configuration of the sleeve sections is intended to mitigate the ingress of adhesive into the waveguide joint, this can only be effectively achieved by very careful control of the quantity of adhesive injected into the 'pockets' and/or the use of an adhesive of relatively high viscosity. In the event that even a slight excess of adhesive is injected into the pockets, that excess adhesive will inevitably ooze into the area of the waveguide joint, adversely affecting the RF performance of the waveguide. The alternative or additional requirement that a relatively highly viscous adhesive is used to try and mitigate the adverse effect of the adhesive on the RF performance of the waveguide, means that there is a severe limitation placed on how thin this layer of adhesive can be made. In applications where RF performance is as critical as minimising the dimensions of the resultant waveguide (due to space restrictions, for example), these issues further restrict the applications in which the described method can be effectively used.

It is an object of aspects of the present invention to address at least some of these issues and, in accordance with a first aspect of the present invention, there is provided a waveguide comprising first and second waveguide sections, each waveguide section comprising a main body portion and a connecting portion at a distal end thereof, the first and second waveguide sections being longitudinally aligned to define a conduit therethrough with a butted interface therebetween, the connecting portion of each waveguide section having: (i) a first circumferential ridge on an outer surface of the respective waveguide section, the first circumferential ridge located adjacent to a distal end of the respective waveguide section, (ii) a second circumferential ridge on its the outer surface of the respective waveguide section, the second circumferential ridge spaced apart from the first circumferential ridge, and (iii) a third circumferential ridge on the outer surface of the respective waveguide section, the third circumferential ridge located between the first and second circumferential ridges, such that a first respective recess is defined between the second and third circumferential ridges and a second respective recess is defined between the first and third circumferential ridges; the waveguide further comprising a sleeve member over the butted interface, such that a respective first cavity is defined between an inner surface of the sleeve member and each respective first recess, and a respective second cavity is defined between the inner surface of the sleeve member and each respective second recess, each the first cavity having a chemical adhesive therein operative to join the first and second waveguide sections together by means of the sleeve member.

The provision of the first circumferential ridges or 'dams', i.e. the second cavity, provides an 'overflow' region for receiving any excess adhesive from the first cavity and preventing ingress thereof into the waveguide joint, thereby providing an improved method of joining the waveguide sections without adversely affecting the RF performance of the resultant waveguide, and without the need for additional sleeve members or the use of highly viscous adhesive.

In an exemplary embodiment, outer edges of each first recess may be joined to, or formed integrally with, the second and third circumferential ridges by respective convex (fillet) corners or 'rounds', which have the effect of reducing stress within the waveguide wall, but also of helping to retain the adhesive in the first cavity. A first outer edge of each second recess may be joined to, or formed integrally with, the third circumferential ridge by a substantially right-angled corner, thereby providing a substantially vertical side wall, which has the effect of ensuring that any adhesive that escapes from the first cavity is captured into the second cavity. A second outer edge of each second recess may also be joined to, or integrally formed with, the first circumferential ridge by a substantially right-angled corner, thereby providing a substantially vertical side wall, which has the effect of preventing any adhesive that has escaped from the first cavity into the second cavity from reaching the butted interface between the first and second waveguide sections.

It will be appreciated that, in a preferred embodiment, the circumferential ridges may define an external diameter of the respective connecting end that substantially matches the inner diameter of the sleeve member. A maximum distance between the ridges and an inner wall of the sleeve member may, in one exemplary embodiment of the invention, be 0.025 mm or less.

The connecting ends of the first and second waveguide sections may be substantially identical, the butted interface may be substantially flat and substantially perpendicular to a waveguide axis defined by the conduit, and the sleeve member may comprise a tubular member configured to surround the butted interface.

The connecting end of the first waveguide section may comprise a male end piece and the connecting end of the second waveguide section may comprise a female end portion including a sleeve portion for receiving the male end portion and aligning the waveguide sections with a choked interface therebetween. The use of a choke design herein may desensitise the electrical performance of the waveguide to the contact conditions and improve PIM performance.

The male end piece may include a recess extending from a distal end thereof and having a length of one quarter of the waveguide wavelength, and the recess of the male end piece, together with a gap between the male and female end pieces and having a length of one quarter of the waveguide wavelength, may thus define the choked interface providing first and second waveguide sections, each waveguide section comprising a main body portion and a connecting portion at a distal end thereof, the connecting portion of each waveguide section having: (i) a first circumferential ridge on an outer surface of the respective waveguide section, the first circumferential edge located adjacent to a distal end of the respective waveguide section, (ii) a second circumferential ridge on the outer surface of the respective waveguide section, the second circumferential edge spaced apart from the first circumferential ridge, and (iii) a third circumferential ridge on the outer surface of the respective waveguide section, the third circumferential ridge located between the first and second circumferential ridges, such that a first respective recess is defined between the second and third circumferential ridges and a second respective recess is defined between the first and third circumferential ridges;

placing the first and second waveguide sections in longitudinal alignment to define a conduit therethrough with a butted interface therebetween;

placing a sleeve member of each of the first and second waveguide sections over the butted interface, such that a respective first cavity is defined between an inner surface of the sleeve member and each respective first recess and a respective second cavity is defined between the inner surface of the sleeve member and each respective second groove; and introducing, into each respective first cavity, a chemical adhesive so as to join the first and second waveguide sections together by means of the sleeve member.

In an exemplary embodiment, the sleeve member may have at least one hole therein, and the method may include the step of injecting the chemical adhesive into the first cavity through the at least one hole.

The method may include the step of applying a preload to the butted interface prior to introducing the chemical adhesive into the first cavity.

The method may include the steps of determining, in respect of a bond-line provided by the chemical adhesive within the first cavity, a maximum strength under shear load, identifying a thickness of the bond-line associated with the determined maximum strength, and providing a first and/or second waveguide section having a connecting end with a recess having a depth substantially matching the thickness.

In accordance with another aspect of the present invention there is provided a waveguide section for use in a method substantially as described above, comprising a main body portion and a connecting portion at a distal end thereof, the connecting portion having: (i) a first circumferential ridge on an outer surface of the connecting portion, the first circumferential ridge located adjacent the distal end of the waveguide section, (ii) a second circumferential ridge on the outer surface of the connecting portion, the second circumferential ridge spaced apart from the first circumferential ridge, and (iii) a third circumferential ridge on the outer surface of the waveguide section, the third circumferential ridge located between the first and second circumferential ridges, such that a first respective recess is defined between the second and third circumferential ridges and a second respective recess is defined between the first and third circumferential ridges.

In accordance with yet another aspect of the present invention, there is provided a connecting end for a waveguide section substantially as described above, comprising a generally tubular member having: (i) a first circumferential ridge on an outer surface of the tubular member, the first circumferential ridge located adjacent a distal end of the tubular member, (ii) a second circumferential ridge on the outer surface of the tubular member, the second circumferential ridge spaced apart from the first circumferential ridge, and (iii) a third circumferential ridge on the outer surface of the tubular member, the third circumferential ridge located between the first and second circumferential ridges, such that a first respective recess is defined between the second and third circumferential ridges and a second respective recess is defined between the first and third circumferential ridges, the connecting end being configured to be affixed to an end of a waveguide section.

In accordance with a further aspect of the invention, there is provided a connecting end for a second waveguide section for use in a method substantially as described above with a first waveguide section substantially as described above, wherein the connecting end comprises a sleeve member configured to receive the connecting end of the first waveguide section, the connecting member being configured to be affixed to an end of the second waveguide section.

BRIEF DESCRIPTION OF THE DRAWINGS

These and other aspects of the invention will be apparent from the following specific description, in which embodiments of the present invention are described, by way of examples only, and with reference to the accompanying drawings, where like features throughout the drawings are denoted by the same reference numbers, and in which.

DETAILED DESCRIPTION

Figure 1:
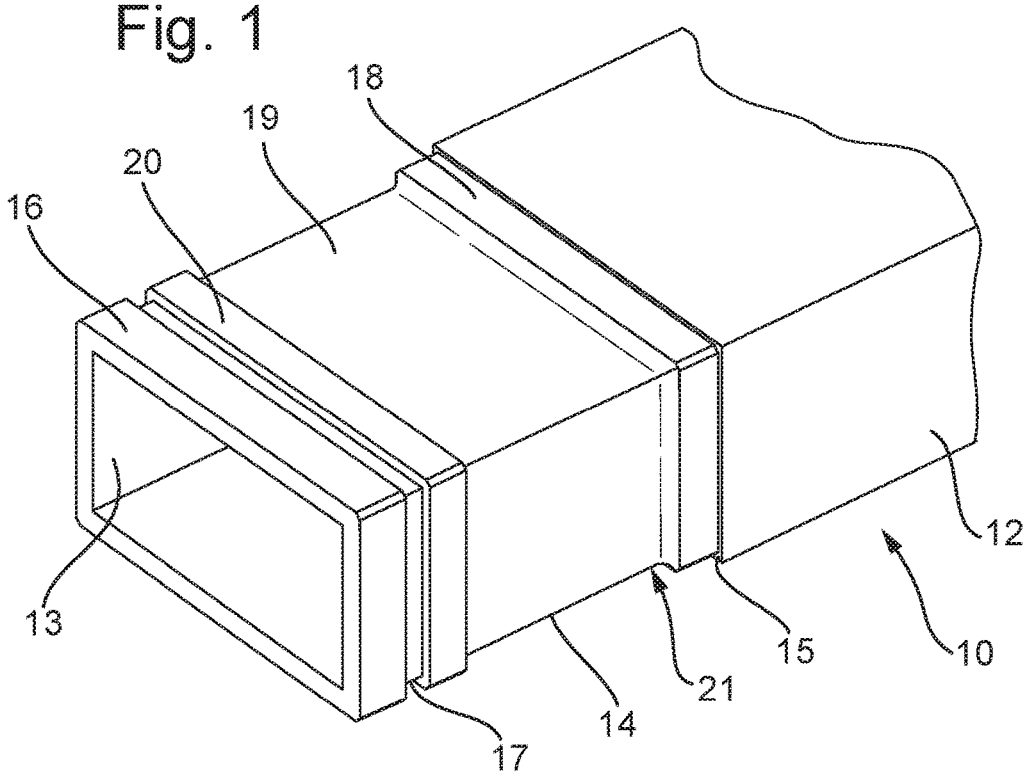
FIG. 1 is a schematic perspective view of a waveguide section according to a first exemplary embodiment of the present invention.

Referring to FIG. 1 of the drawings, a waveguide section 10 according to an exemplary embodiment of the present invention comprises a transmission line formed from a hollow conducting tube of generally rectangular cross-section, providing a conduit through which electromagnetic waves can be propagated, in use. The transmission line comprises two sections: a main body 12 and a connecting end 14. The outer profile of the main body 12 is generally uniform and may be of any known configuration. The connecting end 14 is of the same general cross-sectional shape as the main body 12 and extends concentrically therefrom so as to provide a continuous conduit 13 through the waveguide section, but the overall cross-sectional area of the connecting end 14 is slightly smaller than that of the main body 12 such that there is a small stepped portion 15 where the main body 12 and the connecting end 14 meet.

Three concentric circumferential ridges (or 'dams') 16, 18, 20 are provided on the outer wall of the connecting end 14. A first dam 16 is located at the distal end of the connecting end 14, i.e. furthest from the main body 12. A second dam 18 is located adjacent the stepped portion 15 between the main body 12 and the connecting end 14. A third dam 20 is provided close to, but spaced apart from, the first dam 16 to define a circumferential groove 17 therebetween. The elongate section of the connecting end 14 between the second and third dams 18, 20 defines a second, wider circumferential groove 19. The ends of the section defining the groove 19 are joined or formed integrally with the second and third dams 18, 20 by respective convex (fillet) corners or so-called 'rounds' 21 which have the effect of reducing stress within the waveguide wall.

Figure 2:
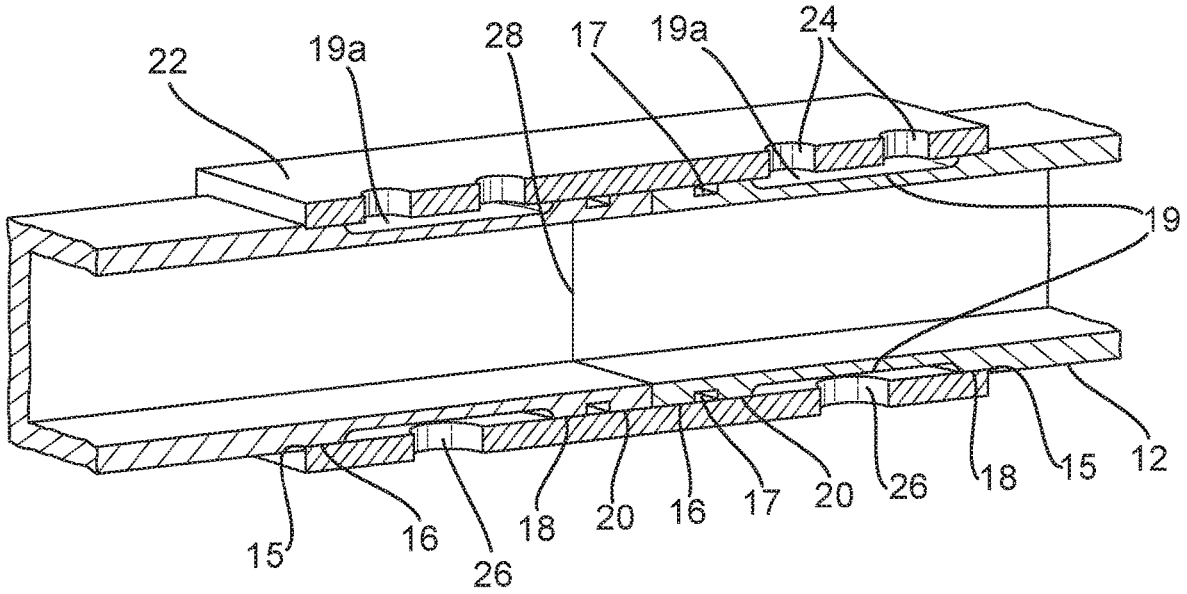
FIG. 2 is a schematic cut-away perspective view of a waveguide according to an exemplary embodiment of the present invention.

In a method, according to an exemplary embodiment of the invention, of manufacturing a waveguide by joining two such waveguide sections together, and referring additionally to FIG. 2 of the drawings, a sleeve 22 is employed. The sleeve 22 comprises a rigid tube of generally rectangular cross-section (in this case) defining a channel therethrough that has inner dimensions to closely fit the outer dimensions of the connecting ends 14 of the waveguide sections (but insufficient to accommodate the outer dimensions of the main body 12), such that the connecting ends can be inserted, via the open ends of the channel, into the sleeve 22 until further insertion of the respective waveguide section is prevented when the end of the sleeve 22 hits the stepped portion 15 between the connecting end 14 and the main body 12. It can be particularly seen in FIG. 2 of the drawings that the sleeve 22 of a length to accommodate, within its channel, two abutted connecting ends 14 (see FIG. 1) of respective waveguide sections, with the opposing end edges thereof each adjacent to, but not in contact with, a respective stepped portion 15.

The sleeve 22 is provided with holes 24, 26 in the upper and lower walls. More specifically, in this exemplary embodiment, two pairs of holes 24 are provided in the 'upper' wall of the sleeve 22 (in the orientation illustrated) and located such that, two abutted waveguide section connecting ends 14 are positioned within the sleeve channel, each pair of holes 24 is adjacent a respective wide circumferential groove 19 defined between second and third dams 18, 20 of the respective connecting end 14. Indeed, it can be seen that, with the sleeve in situ over a pair of abutted connecting ends, pockets 19*a* are defined between the grooves 19 and the adjacent inner wall of the sleeve 22. In this exemplary embodiment, a pair of single holes 26 is provided in the 'lower' wall of the sleeve 22, each hole 26 once again being located such that, when two abutted connecting ends 14 are positioned within the sleeve channel, each hole 26 is adjacent a respective 'pocket' 19*a* defined between a circumferential groove 19 and the adjacent inner wall of the sleeve 22.

Thus, in use, a connecting end 14 of a first waveguide section is inserted into the sleeve channel from one end until that end is adjacent to (but not contacting) the stepped portion 15 of the first connecting end 14. A connecting end 14 of a second waveguide section is inserted into the sleeve channel from the opposite end until that end is adjacent to (but not contacting) the stepped portion 15 of the second connecting end, and the distal ends of the first and second connecting ends are essentially abutted, to create a butted (contact) interface 28.

The holes 24,26 allow adhesive to be injected into the pockets 19*a* formed between the connecting ends and the adjacent inner wall of the sleeve 22 (as discussed above). The continuous 'pockets' 19*a* allow the adhesive to flow completely around the waveguide/sleeve interface, and the pocket dimensions (i.e. length and height) can be selected (or adjusted) to optimise the adhesive bond-line thickness and, therefore, overall strength requirement determined/required by the application, as will be discussed in more detail hereinafter. It will be appreciated that the circumferential grooves 19 defining the pockets 19*a* can, for example, be formed in the respective connecting ends 14 of the waveguide sections by machining the external surface thereof. However, other methods of forming such grooves will be apparent to a person skilled in the art and the present invention is not necessarily intended to limited in this regard. In an alternative exemplary embodiment, the grooves may additionally or alternatively be formed in the in the inner wall of the sleeve, and the present invention is, once again, not necessarily intended to be limited in this regard. Furthermore, it will be understood that greater bond strength is likely to be achieved, at least in most cases, if the adhesive is in direct contact with the base materials. Many high performance waveguides are silver plated to minimise loss and, in this case, it is desirable to ensure that the waveguide surfaces forming the pockets 19*a* are masked, during manufacture, to prevent such plating. There is not thought to be any requirement for the sleeve 22 to be plated, but it may be desirable for the outer surfaces thereof to be coated or otherwise treated, depending on the environment in which it is to be used.

It is essential for good electrical and RF performance of the resultant waveguide that adhesive is prevented from penetrating into the waveguide or significantly across the butted interface 28 between first and second connecting ends. This may be achieved by a) ensuring that the butted waveguide faces are accurately machined to be flat and perpendicular to the waveguide axis; b) ensuring that the clearance between the inner wall of the sleeve 22 and the outer faces of the dams 16, 18, 20 is small, typically, say, 0.025 mm or less; and/or c) applying a preload across the butted interface 28.

With particular reference to b) above, the third dam 20 in this exemplary embodiment is intended to prevent adhesive ingress into the waveguide, and the second dam 18 is intended to prevent excess adhesive from escaping through the end of the sleeve 22 and also to assist in improving the alignment of the sleeve on the waveguide. The ends of the section defining the first groove 17 are joined to, or formed integrally with, the first and third dams 16, 20 by respective right-angled corners. The ends of the section defining the second groove 19 are joined to, or formed integrally with, the second and third dams 18, 20 by respective convex (fillet) corners or so-called 'rounds' 21 (see FIG. 1) which not only have the effect of reducing stress within the waveguide wall, but also of 'discouraging' any adhesive therein from escaping at the side edges. Whilst the first groove 17 is narrower (or shorter) than the second groove 19, its substantially vertical side walls have the effect of a) ensuring that any adhesive that escapes from the second groove 19 is captured into the first groove 17, and b) ensuring that any excess adhesive captured in the first groove 17 does not escape into the butted interface region 28.

However, it will be appreciated that the number and precise location on the connecting end 14 of such dams may vary from that depicted and described above, and the present invention is not necessarily intended to be limited in this regard. The acceptable clearance over the dams 16, 18, 20 may, at least to a certain extent, be a function of adhesive viscosity, as will be understood by a person skilled in the art (i.e. the higher the viscosity, the greater can be the acceptable clearance). However, adhesives that have a relatively low viscosity during curing may require the use of additional sealing means, such as 'O' rings or the like, to seal the waveguide off from the adhesive.

Figure 3:
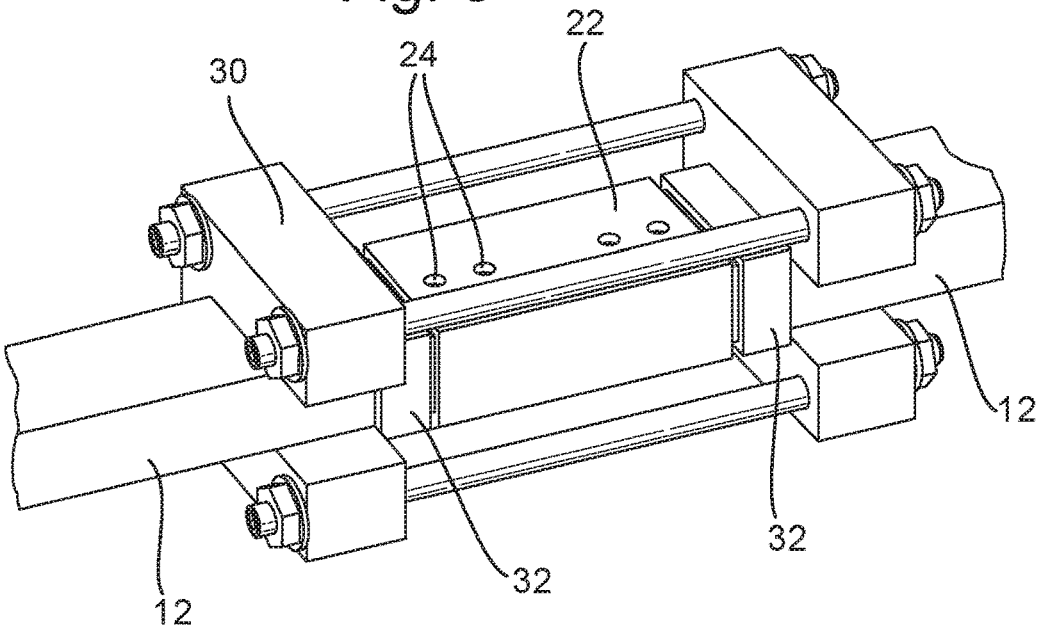
FIG. 3 is a schematic perspective view of a waveguide according to an exemplary embodiment of the present invention illustrating the application of a preload during the manufacturing process.

It will be appreciated from the above that a simple sleeve arrangement of the type described above enables a strong bond-line to be created in a space-saving manner (compared with, for example, flange connections), so as to connect waveguide sections together in a manner that satisfies the above-described requirement for good mechanical, electrical and RF performance. It will be appreciated that, in order to achieve the required high quality adhesive joints, the surfaces to be adhered should be prepared as specified by the manufacturer of the adhesive being used. Furthermore, and with reference to c) above, for a simple butted junction, it is important to ensure good contact pressure at the interface 28. Thus, a preload may be applied at the interface 28, prior to bonding. Referring to FIG. 3 of the drawings, such a preload may be applied by means of a clamp 30, or similar arrangement, configured to be affixed to each of the two waveguide sections being joined, and apply a clamping force that pushes and holds the distal ends together (at the interface 28). In this case, it may be required to provide additional clamping features 32 on the outer surface of the main body 12 of each waveguide section to enable the clamp 30 to be affixed thereto. These features could, for example, be brazed onto, or machined into, the outer walls of the main body 12, depending on the mechanical load requirements. Once the adhesive has been applied and cured, the clamp 30 can be removed.

Figure 4:
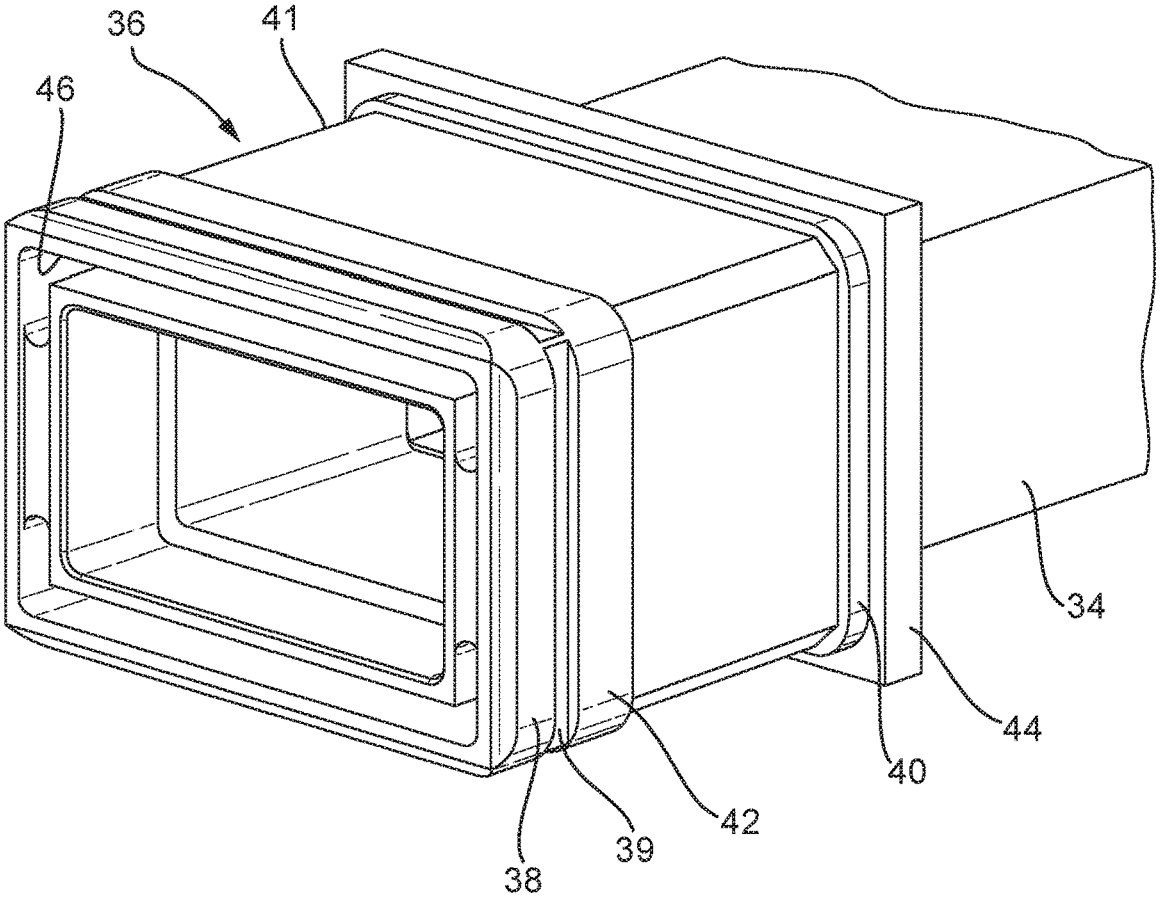
FIG. 4 is a schematic perspective view of a waveguide section according to another exemplary embodiment of the present invention, illustrating a male end piece.

In alternative exemplary embodiments, the 'sleeve' can be incorporated into one of the waveguide sections so that a male-female geometry is formed. Thus, referring first to FIG. 4 of the drawings, a waveguide section having a main body 34 and a male connecting end 36 is illustrated. The connecting end 36 is, in this case, a 'male' end piece and is of similar configuration to that of the connecting end 14 described above and illustrated in FIG. 1 of the drawings. Thus, the male end piece comprises a generally rectangular tube having first and third circumferential ridges or 'dams' 38, 42 close to the distal end, the first and third dams 38, 42 being spaced apart to define a relatively narrow groove 39 therebetween. A second dam 40 is provided close to the end adjacent the main body 34, such that a wider groove 41 is defined between the second and third dams 40, 42 as before. A circumferential flange 44 is located behind the second dam 40, immediately adjacent the main body 34.

Figure 5:
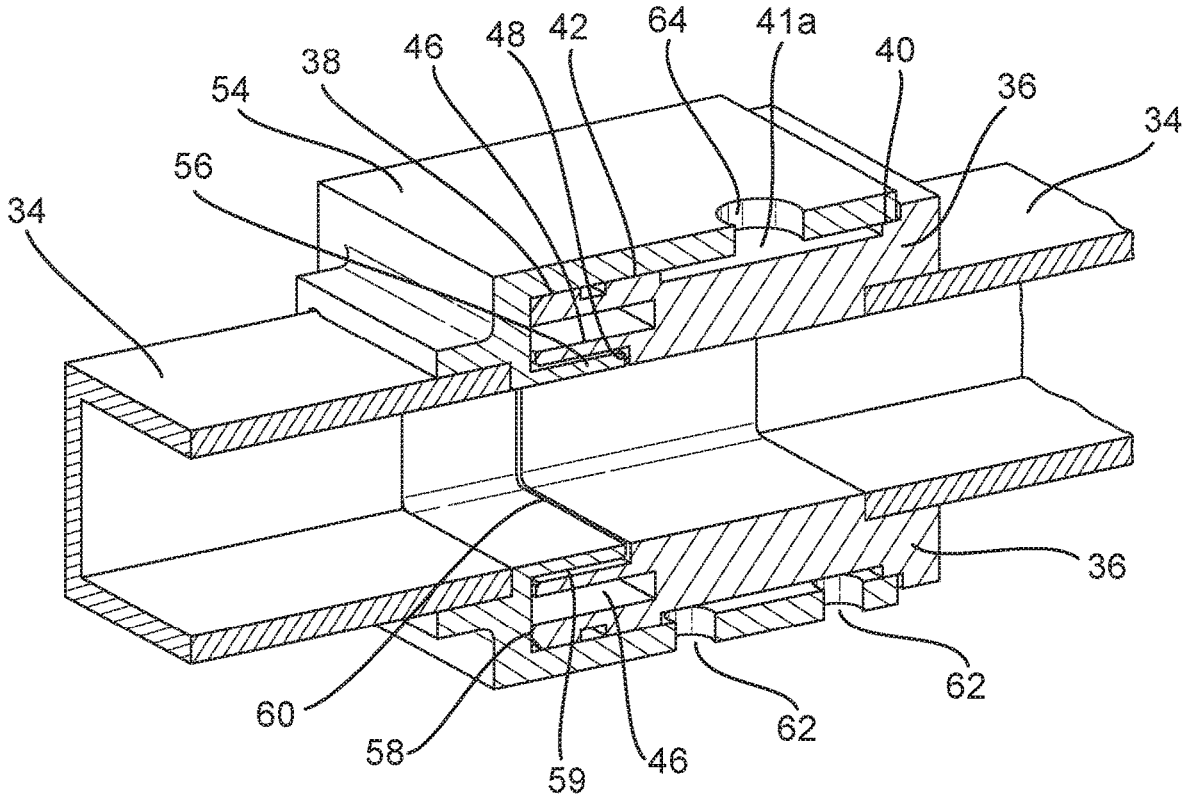
FIG. 5 is a schematic cut-away perspective view of a waveguide according to an exemplary embodiment of the present invention.

Referring additionally to FIG. 5 of the drawings, the wall of the connecting end 36 is provided with a concentric channel 46 that extends all the way around the wall and inwardly therethrough from the distal end. The width (the dimension parallel to the waveguide axis) of the channel 46 is equal to one quarter of the guide wavelength, and is therefore dependent on the frequency band of the application. The inner wall of the connecting end 36 is provided with a stepped recess 48 at its distal end.

Figure 6:
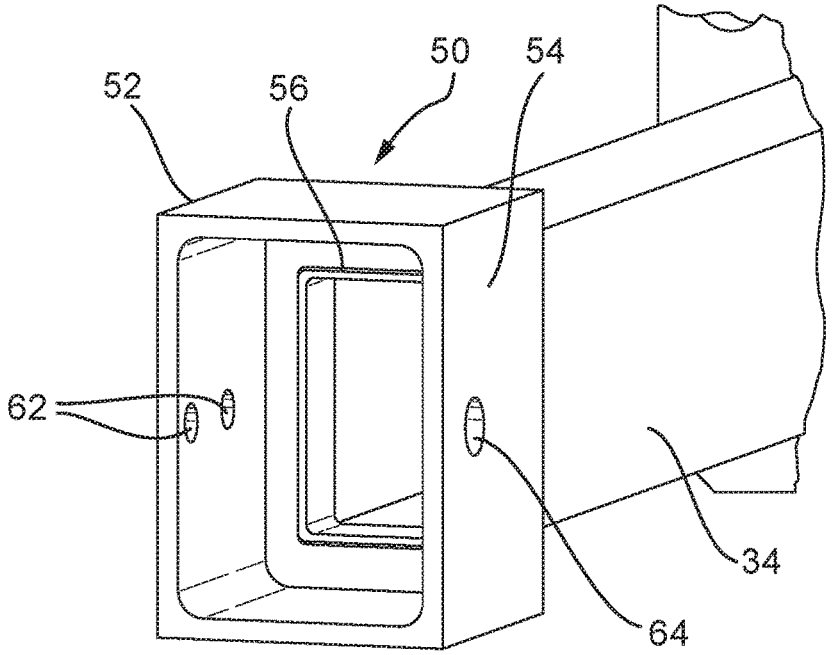
FIG. 6 is a schematic perspective view of a waveguide section according to an exemplary embodiment of the present invention, illustrating a female end piece.

Referring now to FIG. 6 of the drawings, as well as FIG. 5, the female end piece 50 (see FIG. 6) comprises an insert portion defining a 'sleeve' 52 (see FIG. 6) comprising an outer wall 54 and a shorter, concentric inner wall 56 with a recess therebetween. The inner dimensions of the outer wall 54 are such that the inner dimensions closely match those of the outer profile of the corresponding male end piece such that the male end piece can be inserted into the female end piece to form a butted interface at 58 (see FIG. 5). In this configuration, the inner wall 56 of the female end piece rests within the stepped recess 48 (see FIG. 5) in the inner wall of the male end piece (with a gap 59 (see FIG. 5) therebetween) and there is a discrete gap (depicted generally at 60 as shown in FIG. 5) at the junction of the internal waveguide wall. It will be appreciated that the length of the gap leading from 60 (or recess 48) is also one quarter of the waveguide wavelength. The male and female end pieces, thus arranged and configured, form a choked-waveguide interface, wherein the discrete gap 60 leads into an RF quarter-wave choke circuit (formed by the gap 59 and the channel 46). The choke circuit is designed to minimise reflections from the gap 60 over a required frequency band, as will be familiar to a person skilled in the art, and it will be appreciated that the point of contact is, in this case, at 58. Thus, the circuit is designed so that, at the interface 58, the current crossing is minimised, which desensitises the performance of the junction to the conditions at the junction (which may be advantageous, at least for some applications, when compared with the simpler sleeve design described above with reference to FIGS. 1 and 2 of the drawings).

As shown in FIGS. 5 and 6 of the drawings, the outer wall 54 of the sleeve defined by the female end piece is provided with a pair of holes 62 in one wall and a single hole 64 in the opposing wall, wherein the holes 62, 64 are located adjacent the wider groove 41 (see FIG. 4) in the male end piece when it is inserted fully within the sleeve. As before, the number and specific configuration of the holes 62, 64 may vary and the present invention is not necessarily intended to be limited in this regard.

Cavities or 'pockets' 41*a* (see FIG. 5) are thus created between the wider grooves 41 (see FIG. 4) in the male end piece and the inner surface of the outer wall of the female end piece sleeve. As before, such pockets 41*a* can be formed by machining a groove in the outer surface of the male end piece (as shown) or on the inner surface of the female end piece sleeve, or both, and the present invention is not necessarily intended to be limited in this regard. The holes 62, 64 in the outer wall of the female end piece sleeve allow adhesive to be injected into the pockets 41*a*. The continuous pockets 41*a* allow the adhesive to flow completely around the interface between the male and female end pieces and, once again, the pocket dimensions can be designed/adjusted to optimise the adhesive bond-line thickness and overall strength requirement determined by the application. As before, the pockets 41*a* will typically be shallow and designed to maximise the adhesive bond-line strength depending on the adhesive used, and the length of the bond-line can be adjusted to the requirements of the application. Once again, and whilst not clearly shown in FIGS. 5 and 6, the edges of the wider grooves 41 (see FIG. 4) are joined to, or formed integrally with, the second and third dams 40, 42 (see FIG. 5) by a convex (fillet) corner or 'round' and the edges of the narrower groove defined between the first and third dams 38, 42 (see FIG. 5) are joined to, or formed integrally with, the aforementioned dams for the reasons specified in relation to the embodiment of FIG. 2.

It is anticipated that the male and female end pieces can be attached to a standard waveguide using the same or similar methods to those used in the art for connecting flanges thereto. Thus, for example, in the case of a typical aluminium waveguide, the end pieces could be torch brazed onto the waveguide in a manner that will be known to a person skilled in the art.

Figure 7:
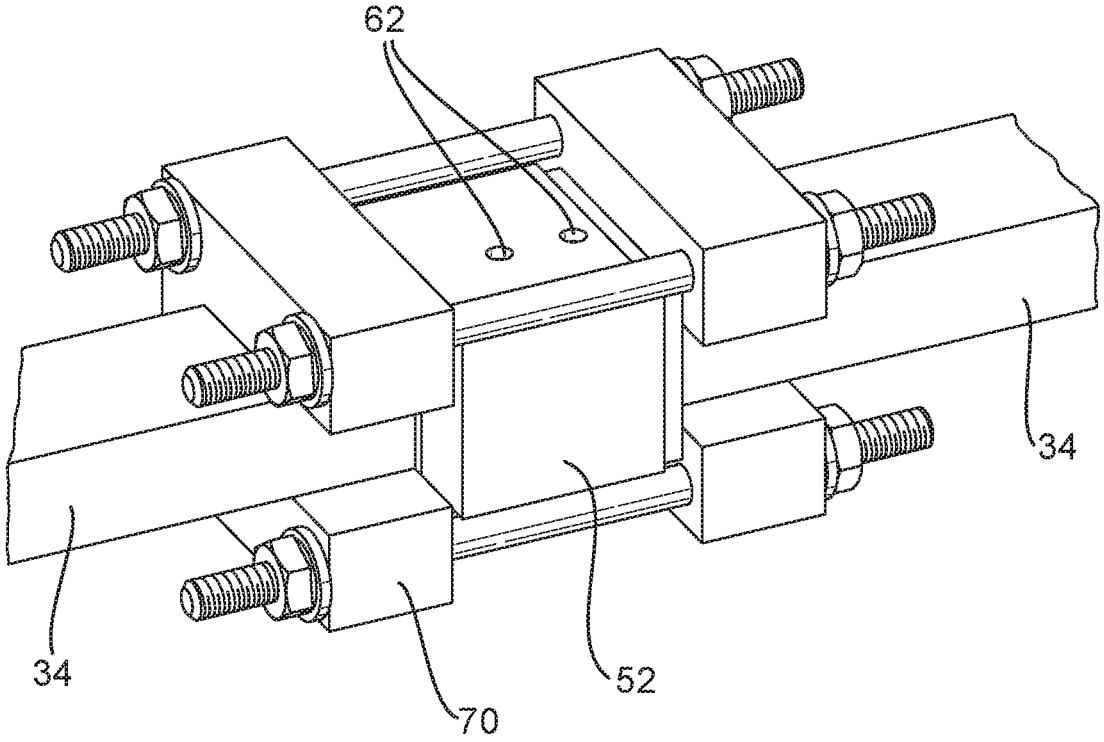
FIG. 7 is a schematic perspective view of a waveguide according to an exemplary embodiment of the present invention illustrating the application of a preload during the manufacturing process.

Once again, and as illustrated schematically in FIG. 7 of the drawings, once the male end pieces has been fully inserted into the female end piece, and the surfaces prepared according to the adhesive manufacturer's instructions/specification, a preload may be applied to the assembly in order to ensure good contact pressure at the interface 58 and thereby minimise surface effects (i.e. oxide layers) upon insertion loss and PIM. Such a preload may be applied by means of a temporary clamp 70 or any other suitable means, as will be apparent to a person skilled in the art.

It will be appreciated that many different types of adhesive may be considered suitable for use in embodiments of the present invention. In some exemplary embodiments, an epoxy paste adhesive (i.e. relatively high viscosity) may be employed. For example, an adhesive such as sold under the trademark HYSOL® 9395 may be used which is a two-component adhesive system which is non-metallic and cures at ambient temperatures, but has excellent strength properties at temperatures of 350° F./177° C. and higher. In this case, a BR127 primer can be used to prepare the surfaces to be adhered. However, the adhesive used will be dependent on many factors, including the specific configuration of the end pieces, the material of which the waveguide is made and the application in which the resultant waveguide is to be used. For example, in some exemplary embodiments, such as those using the simple sleeve configuration described above in relation to FIGS. 1 and 2 of the drawings, an adhesive that cures to a hard resin consistency may be required to ensure that it can maintain the preload applied prior to bonding and maintain good electrical performance.

In all cases, manufacturers of commercially available adhesives usually provide data indicative of the specific bond-line thickness required to give maximum strength under shear load. Thus, the height of the pocket or cavity (19*a*, 41*a*) can be set to achieve this figure.

It will be appreciated by a person skilled in the art, from the foregoing description, that modifications and variations can be made to the described embodiments without departing from the scope of the invention as defined by the appended claims.

The invention claimed is:

1. A waveguide comprising:

first and second waveguide sections, each waveguide section comprising a main body portion and a connecting portion at a distal end thereof, the first and second waveguide sections being longitudinally aligned to define a conduit therethrough with an interface therebetween, the connecting portion of each waveguide section having:

(i) a first circumferential ridge on an outer surface of the respective waveguide section, the first circumferential ridge located adjacent to a distal end of the respective waveguide section, (ii) a second circumferential ridge on the outer surface of the respective waveguide section, the second circumferential ridge spaced apart from the first circumferential ridge, and (iii) a third circumferential ridge on the outer surface of the respective waveguide section, the third circumferential ridge located between the first and second circumferential ridges, such that a first respective recess is defined between the second and third circumferential ridges, and a second respective recess is defined between the first and third circumferential ridges; and a sleeve member disposed over the interface, such that a respective first cavity is defined between an inner surface of the sleeve member and each respective first recess, and a respective second cavity is defined between the inner surface of the sleeve member and each respective second recess, each respective first cavity having a chemical adhesive therein operative to join the first and second waveguide sections together by means of the sleeve member.

2. The waveguide according to claim 1, wherein outer edges of each first recess are joined to, or formed integrally with, the second and third circumferential ridges by respective convex corners.

3. The waveguide according to claim 2, wherein an outer edge of each second recess is joined to, or formed integrally with, the third circumferential ridge by a substantially right-angled corner.

4. The waveguide according to claim 2, wherein the first, second and third circumferential ridges define an external diameter of the respective connecting end that substantially matches the inner diameter of the sleeve member.

5. The waveguide according to claim 1, wherein the first, second and third circumferential ridges define an external diameter of the respective connecting portion that substantially matches an inner diameter of the sleeve member.

6. The waveguide according to claim 5, wherein a maximum distance between at least one of the first, second and third circumferential ridges and the inner surface of the sleeve member is 0.025 mm or less.

7. The waveguide according to claim 1, wherein the interface is a butted interface that is substantially flat and substantially perpendicular to a waveguide axis defined by said conduit, and wherein the sleeve member comprises a tubular member configured to surround the butted interface.

8. The waveguide according to claim 1, wherein the connecting portion of the first waveguide section comprises a male end piece and the connecting portion of the second waveguide section comprises a female end piece for receiving the male end piece and aligning the respective waveguide sections to form the interface as a choked interface between the male end piece and the female end piece.

9. The waveguide according to claim 8, wherein the male end piece includes a recess extending from a distal end thereof and having a length of one quarter of the waveguide wavelength, and the recess of the male end piece, together with a gap between the male and female end pieces of length one quarter of the waveguide wavelength, defines the choked interface.

10. The waveguide according to claim 1, wherein a first outer edge of each second recess is joined to, or formed integrally with, the third circumferential ridge by a substantially right-angled corner.

11. The waveguide according to claim 10, wherein the first, second and third circumferential ridges define an external diameter of the respective connecting end that substantially matches the inner diameter of the sleeve member.

12. The waveguide according to claim 10, wherein second outer edge of each second recess is joined to, or integrally formed with, the first circumferential ridge by a substantially right-angled corner.

13. The waveguide according to claim 12, wherein the first, second and third circumferential ridges define an external diameter of the respective connecting end that substantially matches the inner diameter of the sleeve member.

14. A method of manufacturing a waveguide comprising:

providing first and second waveguide sections, each waveguide section comprising a main body portion and a connecting portion at a distal end thereof, the connecting portion of each waveguide section having:

(i) a first circumferential ridge on an outer surface of the respective waveguide section, the first circumferential ridge located adjacent to a distal end of the respective waveguide section, (ii) a second circumferential ridge on the outer surface of the respective waveguide section, the second circumferential ridge spaced apart from the first circumferential ridge, and (iii) a third circumferential ridge on the outer surface of the respective waveguide section, the third circumferential ridge located between the first and second circumferential ridges, such that a first respective recess is defined between the second and third circumferential ridges, and a second respective recess is defined between the first and third circumferential ridges;

placing the first and second waveguide sections in longitudinal alignment to define a conduit therethrough with a butted interface therebetween;

placing a sleeve member over the butted interface, such that a respective first cavity is defined between an inner surface of the sleeve member and each respective first recess, and a respective second cavity is defined between the inner surface of the sleeve member and each respective second recess; and introducing, into each respective first cavity, a chemical adhesive so as to join the first and second waveguide sections together by means of the sleeve member.

15. The method according to claim 14, wherein the sleeve member has at least one hole therein, and the method includes injecting the chemical adhesive into the first cavity through the at least one hole.

16. The method according to claim 15, wherein the method includes applying a preload to the butted interface prior to introducing the chemical adhesive into the first cavity.

17. The method according to claim 14, including determining, with respect to a bond-line provided by the chemical adhesive within the first cavity, a maximum strength under shear load, and identifying a thickness of the bond-line associated with the determined maximum strength, wherein the respective first recess in the connecting portion has a depth substantially matching the thickness of the bond-line.

18. An apparatus comprising a waveguide section, the waveguide section including a main body portion and a connecting portion at a distal end of the waveguide section, the connecting portion having:

(i) a first circumferential ridge on an outer surface of the connecting portion and located adjacent to the distal end of the connecting portion, (ii) a second circumferential ridge on the outer surface of the connecting portion, the second circumferential ridge spaced apart from the first circumferential ridge, and (iii) a third circumferential ridge on the outer surface of the connecting portion, the third circumferential ridge located between the first and second circumferential ridges, such that a first respective recess is defined between the second and third circumferential ridges and a second respective recess is defined between the first and third circumferential ridges.

19. The apparatus of claim 18, wherein the outer surface of the connecting portion includes a tubular member having:

(i) the first circumferential ridge disposed on an outer surface of the tubular member and adjacent to a distal end of the tubular member, (ii) the second circumferential ridge disposed on the outer surface of the tubular member spaced apart from the first circumferential ridge, and (iii) the third circumferential ridge disposed on the outer surface of the tubular member between said first and second circumferential ridges, such that the first respective recess is defined between the second and third circumferential ridges, and the second respective recess is defined between the first and third circumferential ridges, the connecting portion being configured to be affixed as the distal end of the waveguide section.

20. The apparatus of claim 19, wherein the waveguide section is a first waveguide section, the apparatus further comprising a connecting portion for a second waveguide section for use with the first waveguide section, wherein the connecting portion of the second waveguide section comprises a sleeve member configured to receive the connecting portion of the first waveguide section, the connecting member portion of the second waveguide section being configured to be affixed to an end of the second waveguide section.

* * * * *